United States Patent [19]

Balmer et al.

[11] Patent Number: 4,816,317

[45] Date of Patent: Mar. 28, 1989

[54] DECORATIVE SURFACE COVERINGS

[75] Inventors: Richard H. Balmer, Manheim; Patricia L. Wertz, Lancaster, both of Pa.

[73] Assignee: Armstrong World Industries, Inc., Lancaster, Pa.

[21] Appl. No.: 139,769

[22] Filed: Dec. 30, 1987

Related U.S. Application Data

[63] Continuation-in-part of Ser. No. 59,518, Jun. 8, 1987, abandoned.

[51] Int. Cl.[4] ..... B05D 5/06

[52] U.S. Cl. ..... 428/167; 428/168; 428/172; 428/173

[58] Field of Search ..... 428/156–173

[56] References Cited

U.S. PATENT DOCUMENTS

| | | | |
|---|---|---|---|
| 1,873,098 | 8/1932 | Young | 428/167 |
| 1,989,704 | 2/1935 | Lequillon | 428/167 X |
| 2,057,873 | 10/1936 | Atwood | 428/167 X |
| 2,366,209 | 1/1945 | Morris | 428/167 |
| 2,587,594 | 3/1952 | Charannes et al. | 428/167 X |
| 3,305,381 | 2/1967 | vanWagenen | 428/167 X |
| 3,804,657 | 4/1974 | Eyman et al. | 428/172 X |
| 3,810,813 | 5/1974 | Ellis | 428/172 |
| 3,931,429 | 1/1976 | Austin | 428/172 X |
| 3,958,043 | 5/1976 | McKee, Jr. et al. | 428/172 X |
| 4,068,030 | 1/1978 | Whitman | 428/172 X |
| 4,126,727 | 11/1978 | Kaminski | 428/172 |
| 4,214,028 | 7/1980 | Shortway et al. | 428/172 X |
| 4,320,163 | 3/1982 | Schwartz | 428/172 X |

*Primary Examiner*—Nancy A. B. Swisher

[57] ABSTRACT

A surface covering product is disclosed which comprises a substrate material, an impervious coating upon said material with a decorative design as part of the impervious coating, and, raised transparent or slightly translucent elements printed upon said coating. The raised elements are formed as dot-shaped transparent elements and comprise a thixotropic plastic. An opaque material surrounds the raised elements and the decorative design can be seen only through the raised elements.

7 Claims, 1 Drawing Sheet

DECORATIVE SURFACE COVERINGS

CROSS-REFERENCE TO RELATED APPLICATION

The present application is a continuation-in-part of co-pending application Ser. No. 059,518, filed June 8, 1987 now abandoned.

BACKGROUND OF THE INVENTION

The present invention relates to a surface covering product. In particular, the present invention relates to a surface covering product comprising a substrate; a decorative design on one surface of the substrate, a first impervious layer substantially covering said substrate and design; a second layer partially covering said first layer, said second layer comprising discrete raised portions of a thixotropic plastic material; and, a third layer filling in part of the area between the raised portions of the second layer.

In the prior art, it is known to provide surface covering products having disposed thereon raised elements which contain particles of solid material. For example, U.S. Pat. No. 4,348,447 to Miller and Petzold shows non-skid plastic flooring structures in which inorganic particles are embedded in a cured plastic matrix in a substantially abutting relationship. Since the adhesive can be printed in a selective pattern, the raised elements give the appearance of an embossed-in register flooring material. Because such particles are applied to the adhesive surface of the matrix, however, particles applied in this manner typically do not penetrate uniformly throughout the plastic matrix. In addition, the number of particles is substantially limited and the particles must be covered over with a thin coating of clear plastic material to fully bond them to the material. In coating the particles with such a thin film, the underlying coating, interstitial to the raised elements, is coated also.

In the above reference, however, the raised elements, while they may have some decorative value per se, nevertheless do and would interfere with and obscure any underlying decoration, if such decoration were present. Further, such raised elements while useful for increasing wear resistance and slip resistance, create additional difficulties in the maintenance of the surfaces, and additional care must be taken in the maintenance of flooring employing such devices.

SUMMARY OF THE PRESENT INVENTION

It is an object of the present invention to provide a surface covering product having elements of enhanced decorative effect in a product without the maintenance difficulties typically associated with raised elements.

According to one embodiment of the present invention, there is provided a decorative surface covering producing comprising: (a) a substrate; (b) a design on the substrate; (c) a first impervious wear layer of a synthetic plastic polymeric material, said layer substantially covering one surface of said substrate and design; and (d) a second layer partially covering said first wear layer, said second layer comprising discrete raised portions of a thixotropic plastic material; and a third layer filling in part of the area between the raised portions of the second layer.

DETAILED DESCRIPTION OF THE INVENTION

U.S. patent application Ser. No. 4,873, now U.S. Pat. No. 4,709,631, having a common assignee, shows a surface covering product comprising a substrate material, an impervious coating upon said substrate material, and raised elements selectively disposed upon said coating, which raised elements comprise a thixotropic plastic containing particles of solid material. The disclosure in this earlier application are hereby incorporated by reference as if set forth fully herein.

The raised elements disclosed in the above-cited application, however, are intended to increase the wear and slip resistance of the surface covering product. Other than providing a textured surface, it was not initially perceived that such raised elements could serve a significant decorative function.

It has now, surprisingly, been found that such raised elements can serve as a design enhancement, creating unique visual effects. In particular, where the raised elements are transparent or slightly translucent, their presence reflects the color of an underlying design and providing a unique combination of visual and aesthetic product design effects.

Figure 1:
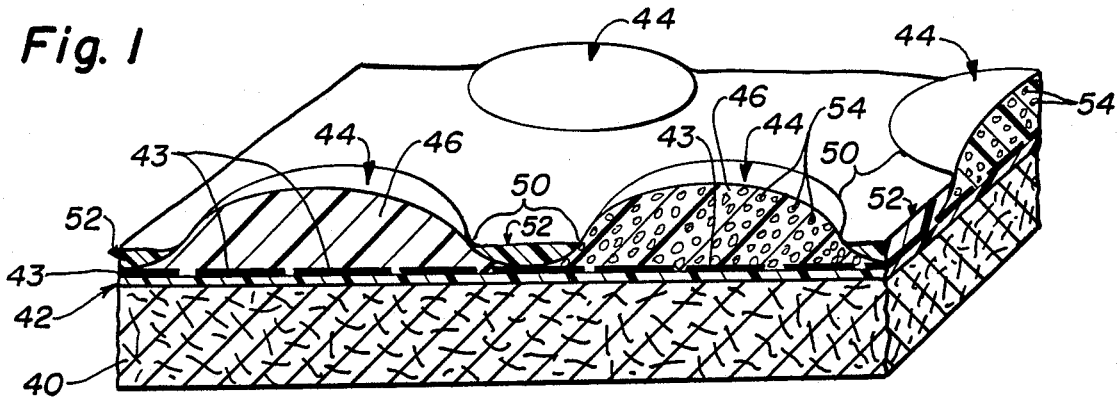
FIG. 1 shows a perspective view with a cross-sectional of an embodiment of the present invention.

FIG. 1 shows an example in which this visual effect is particularly striking. In FIG. 1, an embodiment of the present invention is disclosed. In this embodiment, intended to be illustrative, an impervious coating (42) including decorate details, illustrated as (43), is provided on a substrate (40). In practice, coating (42) might be as simple as a sealant for a wet-laid felt or as complex as a multi-layered, multi-element construction. The practice of the present invention, in this or another embodiment, is not intended to be bound by the particular coating employed. Many coatings and coating methodologies are known to the art which would have application to the present invention, including foamable and non-foamable plastisols, resinous dry blends, stencil lay-ups, and the like.

Raised elements (44) of a thixotropic plastic material (46) are then provided over the coating (42), and a wearlayer coating (52) is provided over the interstitial areas (50). Differing transparencies between the thixotropic material (44) and the interstitial wearlayer (52) can reflect more or less of the decorative details (43), creating interesting visual effects.

Since solid particles can interfere with the transparency, and therefore the lenticular effect of the raised elements, particular designs may choose not to employ such particles where the requirements for wear resistance are not as great. Further, the interstitial wearlayer coating (52) can vary in thickness and may, if desired, fill in up to 30% to 80% of the level of the raised elements. The raised elements 44 reflect the colors of the decorative details 43 and the product has a visual appearance akin to a dot pattern floor.

A transparent or slightly translucent material may be used in the raised elements, but the translucent material must permit one to view the colors therebelow to the extent to create a color effect thereof in the finished product. Also any solid particles such as 54 must be transparent or slightly translucent and small in size so that they will not cause the loss of the dot color effect.

It has been noted that a slightly translucent effect is preferable wherein particles in the raised elements cause a diffusion of the light within the raised elements which result in the preferred visual effect.

Figure 2:
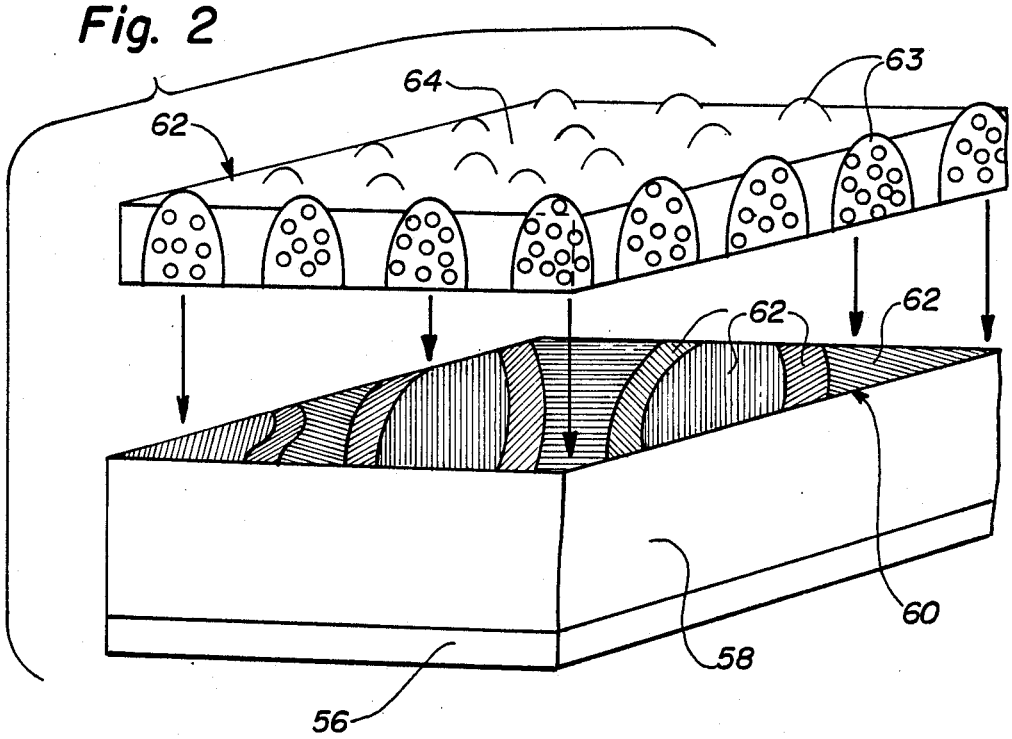
FIG. 2 shows a perspective view of another embodiment of the present invention.

In FIG. 2 there is shown another example of the invention herein.

The product shown is made on a release carrier 56. The impervious coating 58 is a 0.040 inch thick layer of PVC plastisol. On the upper surface of coating 58 is a printed conventional vinyl ink with design 60 of many varied colors 62. The wear layer for the layers 58 and 60 is the layer 62 composed of the elements 63 and 64. The dot-shaped elements 63 are similar to the raised elements 44 of FIG. 1. The element 64 is the coating that is used to fill in the depressed areas around the raised element 63. It can be seen that the upper surface of the product has a nubby surface and the exposed tops of the elements 63 reflect the colors of the underlying design 60.

Figure 3:
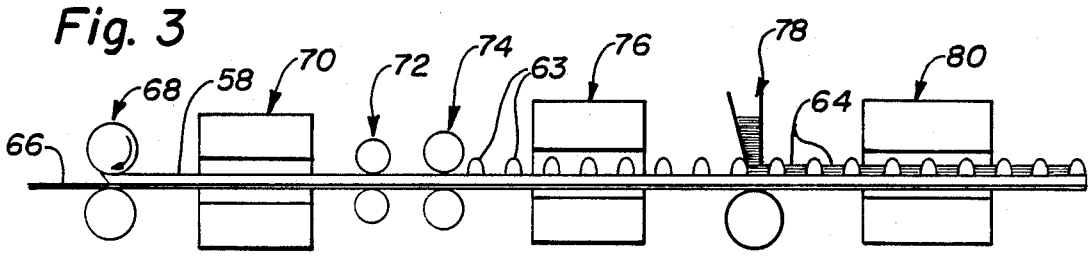
FIG. 3 shows a schematic drawing of a method of making the product of FIG. 1.

In FIG. 3, there is shown a method of making the product of FIG. 2. A release carrier 66 is coated with the PVC plastisol 58. The plastisol is applied by a reverse roll coater 68. An oven 70 gells the plastisol coating 58. A printer 72 applies the vinyl ink to form a multi-colored design. A rotary screen printer 74 applies the dot-shaped elements 63. The oven 76 gells the elements 63 the same way as the coating 58 was gelled. The fill-in coating 64 is applied with a knife over roll coater 78. The resultant product is then fused in the oven 80 at 390° F. for 1.5 minutes.

The Substrate

The present invention is not believed to be dependent on the substrate employed. Rather, it is believed that any of the substrates normally employed in the surface covering field can be employed in the practice of the present invention.

The substrate or backing sheet should be composed of strong, durable and flexible material. The backing can be woven, felted or a solid sheet of synthetic or natural flexible material. The conventional flexible flooring backing is a web of felted fibers. The felt generally is produced using a Fourdrinier or cylinder paper machine with the thickness of the resulting sheet being that usually used in floor and wall covering, that is, from 0.02 to 0.08 inch. A thickness of about 0.032 inch is usually preferred. The fibrous material used is normally cellulosic, although other fibers can be used including those of mineral and animal origin. The sources of cellulosic material can include cotton or other rag material, wood pulp including both ground wood and chemical wood pulp, paper, boxes, or mixtures thereof in any portion. The web can also contain fillers, such as wood flour.

The felt can be strengthened and improved in water resistance by impregnation with a bituminous material. Numerous bituminous materials are well-known as impregnants in the production of printed surface coverings and include asphalts of petroleum or tars and pitch residues of animal or vegetable origin. These materials can be treated to attain the desired physical properties of softening point or viscosity for satisfactory use by such treatment as air blowing, steam distillation, and the like.

The impregnant should be uniformly dispersed throughout the felt sheet. This can be controlled to some extent by the saturating technique through use of pressure rolls in the saturating bath. Where the impregnant is not uniformly dispersed throughout, blistering can frequencty occur due to high concentrations of material adjacent to one surface of the felt.

If an impregnated backing sheet is used, it usually is provided with one or more seal coats, such as lacquer, prior to printing the decorative design. The seal coats perform the desirable function of masking the color of the felt and preventing the impregnant from bleeding through and staining the wear layer and, in addition, create a smooth uniform surface suitable as a base for printing. Felt sheets of the type commonly used as backings for printed surface coverings tend to have minor surface irregularities due to non-uniformities in the felt-making equipment. The sheet also frequently shows a number of small protruding length of fibers. The seal coats are designed to hide all these irregularities. The total thickness of seal coats required is normally from about 1 to about 12 mils. This thickness can be created through use of a single thick coating or several superimposed thinner coatings. Using the conventional techniques of coating, such as flexible doctor roller application, the desired thickness is created by use of more than one coating. The use of multiple coatings is also desirable in promoting optimum adhesion of the wear surface layer to the backing, since the seal coat applied directly to the fibrous backing can be designed for optimum sealing against migration of bituminous impregnant and the uppermost seal coat can be designed for optimum adhesion to the polyvinyl chloride surface wear layer.

Certainly, it is not envisioned that the present invention will be limited in anyway by the choice of substrate. In fact, although a substrate of some kind is normally required to provide necessary mechanical strength in processing, surface coverings are well known in which a strippable, release carrier is employed. Such a release carrier can then be removed from the surface covering product subsequent to the final fusion procedure. Such a strippable substrate is within the scope of the present invention.

Choices among available substrates, therefore, should be made on some basis such as manufacturing convenience or physical properties of the end product.

The Design

Once the substrate is chosen, it is provided with a printed design of multi-colors. The design is an arrangement of colors that represents a geometric or random design arrangement.

The Impervious Coating

Once a substrate is chosen and printed, it should be coated with a suitable impervious material. While it would be possible to apply the raised elements directly to a wet-laid felt, unless a plastic wear layer is applied to protect the interstitial felt, the product would have limited commercial value.

Of course, a glass mat substrate must be prepared with an impervious coating, usually a plastisol which may or may not be foamable, to impregnate the mat and seal the glass fibers.

As noted previously, the coating which must be employed may be as simple as a single layer or as complex as a multi-layered, multi-element construction. The practice of the present invention is not intended to be bound by the particular coating employed. Many coatings and coating methodologies are known to the art which would have application to the present invention, including, but by no means limited to, foamable and non-foamable plastisols, resinous dry blends, stencil lay-ups and the like.

The coating should, however, be impervious so that the thixotropic material deposited thereon remains on the surface to form a discrete element.

The impervious coating may be above the printed design, applied before the printed design or applied above and below the printed design.

The Raised Elements

Over the impervious coating discrete elements are created by depositing beads of a pseudoplastic thixotropic liquid which may contain solid particles. Such deposition can be carried out using various methods known to the art, however, screen printing, though normally employed to deposit inks on more porous surfaces, has been employed with good success.

The elements may be in any shape or pattern, however, geometrics such as repeated patterns of raised circles, squares, diamonds, and the like have been demonstrated to be effective visually.

The discrete elements may be from about three one-thousandths of an inch (0.003") to about eight one-hundredths of an inch (0.08") above the underlying construction, preferably from about fifteen one-thousandths of an inch (0.015") to about forty-five one-thousandths of an inch (0.045"), and most preferably, about three one-hundredths of an inch (0.03"). Further, such raised elements cover from about thirty percent (30%) to fifty percent (50%) of the total surface area in the final product in order to provide an effective colored visual, with the exact percentage a function of the decorative material and the visual effect desired.

The Thixotropic Material

The preent invention is made possible through the combination of an impervious coated substrate and the rheological characteristics of the plastic material applied. With an application methodology such as a rotary screen, a pseudoplastic thixotropic material can be deposited on the impervious coated substrate, typically in thicknesses exceeding that of normal printing inks. Because of the properties of the material, lateral flow can be controlled or substantially eliminated.

A thixotropic material is a material which exhibits dual rheological behavior, that is, they impart high viscosity to systems under low shear and low viscosity under high shear.

Fumed and precipitated silicas are probably the most often used thixotropic agents, or thixotropes, although various inorganic and organic materials are known to be operative, including such inorganic materials as very fine particle, organophilic clays and such organic materials as high substituted sorbatols or calcium/organic complexes. Fumed silicate, available commercially from the Degussa Company, under the trade designation Aerosil 200, has been employed to advantage.

The quantity of such material added to the resin paste system will determine the thixotropic nature of the resulting system, and its viscosities under various rates of shear. Such properties will determine the lateral flow of the plastisol deposited as raised elements on the substrate.

Various resinous materials may be employed as the thixotropic material in the present invention and these include virtually any useful resinous plastisols, while polyvinyl chloride resins have been employed with advantage.

To be useful in the practice of the present invention, sufficient thixotropic material must be present to enable the resin system to remain plastic under shear, losing its pseudoplastic characteristics rapidly when the shear force is removed.

The Particles

Although the thixotropic material can by itself provide the discrete elements of the surface covering product, abrasion properties of such surface covering will typically be greatly improved by the addition of solid particles. Such particles may be an inorganic material such as silica quartz or the like. These particles may be clear or slightly translucent.

In order to be useful as an abrasion resistive material in the present invention, the particles should be of suitable dimension to pass through a No. 10 U.S. Standard seive series mesh, a screen (U.S. Standard) with openings of about two millimeters (2.0 mm) and yet be retained on a No. 200 mesh screen (U.S. Standard), with openings of about seventy microns (70 μ.m.). Preferred results, however, have been obtained with particles which would pass through a No. 25 mesh screen (U.S. Standard) with openings of about six hundred microns (600 μ.m.) and be retained on a No. 50 mesh screen (U.S. Standard), with openings of about two hundred fifty microns (250 μ.m.). The particles of solid material are of a MOHS hardness of 7 to 9, and preferably about 7.

The Final Coating

A final coating is applied to the product of fill in part of the area between the raised portions of the thixotropic material. This coating is normally colored or otherwise made opaque to conceal the design thereunder. The coating is of wear layer quality and can be any commercial wear layer material for flooring.

EXAMPLE 1

A twenty-inch (20") wide portion of release paper was prepared for use as a substrate. First, the paper was coated with forty mils (40 mils) of a non-foamble PVC plastisol of a commercial formulation, which was gelled in a hot air oven at 270° F. for two minutes. The formulation of the plastisol which forms the impervious layer is as follows:

| | | Weight Percent |
|---|---|---|
| Primary Plasticizer | Dioctyl Phtalate | 13.2 |
| Stabilizer | Synpron 1522 | 1.3 |
| Stabilizer/Plasticizer | Epoxidized Soya Oil | 1.8 |
| Plasticizer | Texanol Isobutyrate TXIB | 16.5 |
| PVC Resin | Tenneco 1732 | 16.6 |
| PVC Resin | Geon 121 | 34.1 |
| PVC Resin | GoodYear M-70 | 16.5 |
| | | 100.0 |

A decorative design image in the form of a printed conventional vinyl ink was applied over the impervious material prepared in the above manner. This provides the design of multi-colors.

Using a rotary screen equipped with a screen approximately two one-hundredths of an inch (0.02") in thickness, a 25 to 30 mil thixotropic slurry was selectively deposited in a pattern of circular dots on the surface of the gelled material. The slurry was a suspension of clear particles composed of small diameter quartz and polyvinyl chloride particles of less than 600 microns in diameter in liquid plastisol. The particles were a MOHS hardness of 7. The slurry employed had the following formulation:

| | | Weight Percent |
|---|---|---|
| Primary Plasticizer | Dioctyl Puthalate | 11.0 |
| Stabilizer | Synpron 1522 | 1.3 |
| Stabilizer/Plasticizer | Epoxidized Soya Oil | 1.1 |
| Plasticizer | Texanol Isobutyrate | 13.4 |
| Maleic Acid Ester | Perenol E-2 | 1.6 |
| Surfactant | Surfynol 104A | 1.15 |
| PVC Resin | Tenneco 1732 | 13.4 |
| PVC Resin | Geon 121 | 27.9 |
| PVC Resin | GoodYear M-70 | 13.4 |
| Fumed Silica | Aerosil 200 | 1.0 |
| Pigmented PVC Resin | Geon 103 FPF76 | 0.25 |
| Filler | Quartz | 14.5 |
| | | 100.0 |

The viscosity of the slurry with particles set forth above must be between 110 to 150 poise for the desired results. Viscosity is measured with a Brookfield Visiometer using a No. 6 spindle at 20 revolutions per minute. Viscosity is adjusted by varying the amounts of plasticizer, i.e. TXIB.

A knife over roll coater was then used to apply a plastisol slurry to fill in the depressed areas around the raised printed dot image of the previous plastisol. This plastisol slurry was comprised of:

| | | Weight Percent |
|---|---|---|
| Plasticizer | Texanol Isobutyrate TXIB | 13.0 |
| Stabilizer/Plasticizer | Epoxidized Soya Oil | 1.5 |
| Plasticizer | Nuoplaz 6000 | 13.0 |
| Stabilizer | Synpron 1522 | 1.3 |
| Maleic Acid Ester | Parenol E-2 | 2.0 |
| Surfactant | Surfynol 104A | 1.3 |
| PVC Resin | Tenneco 1734 | 18.8 |
| PVC Resin | Geon 179 | 33.3 |
| PVC Resin | Geon 213 | 13.0 |
| Pearl Pigment | Afflair 163 | 2.8 |
| | | 100.0 |

The material prepared in this manner was then fused in a high temperature oven at 390° F. to 400° F. for approximately 1.5 to two minutes. The resulting surface covering had a unique visual appearance showing an over-all geometric pattern with a subtle nubbed texture of various colors.

What is claimed is:

1. A decorative surface covering product comprising:

(a) a substrate;

(b) a first impervious layer of a synthetic plastic polymeric material, said layer bonded to at least one surface of said substrate;

(c) a decorative design on said impervious layer to provide a design of selected colors;

(d) a second layer partially covering said first layer, said second layer comprising discrete raised portions of 0.015 to 0.045 inches in height of a substantially transparent cured thixotropic plastic material forming raised elements extending upwardly therefrom with depressed areas around the raised elements; and (e) a third opaque layer filling in part of the depressed areas whereby the decorative design is obscured by the third layer, but is visible through the second layer to color the raised elements.

2. The decorative surface covering product of claim 1 wherein the first impervious layer is comprised, in substantial part, of resin particles.

3. The decorative surface covering product of claim 1 wherein the second layer comprises raised discrete dot-shaped elements which are positioned on the first impervious layer and said raised elements are preferably 0.015 to 0.045 inches in height at the center of the raised shape.

4. The decorative surface covering product of claim 3 wherein the raised discrete elements form a repetitive pattern with the raised portions covering substantially 30 to 50 percent of the first layer.

5. The decorative surface covering product of claim 4 wherein the raised discrete portions contain solid particles of a MOHS hardness of at least 7 and a diameter size of 600 microns or less.

6. The decorative surface covering product of claim 5 wherein the thixotropic plastic material contains at least one thixotropic chosen from the group consisting of fumed silicas, precipitated silicas, finely powdered organophilic clays, highly substituted sorbatrols and calcium/organic complexes.

7. The decorative surface covering product of claim 1 wherein the third layer fills in 30 to 80 percent of the depressed areas around the raised elements.

* * * * *